US005121841A

United States Patent [19]

Harrington et al.

[11] Patent Number: 5,121,841

[45] Date of Patent: Jun. 16, 1992

[54] METHOD AND APPARATUS FOR SEPARATING AND FEEDING SEED COTTON MODULES

[75] Inventors: Keith Harrington; Donald Rodgers, both of Sherman, Tex.

[73] Assignee: Continental Conveyor & Equipment Company, Sherman, Tex.

[21] Appl. No.: 563,514

[22] Filed: Aug. 6, 1990

[51] Int. Cl.[5] ..... B07C 5/36

[52] U.S. Cl. ..... 209/616; 19/80 R; 209/606; 241/101.01

[58] Field of Search ..... 209/606, 615, 616; 19/80 A, 80 R; 241/79, 101 A

[56] References Cited

U.S. PATENT DOCUMENTS

| | | | |
|---|---|---|---|
| 3,897,018 | 7/1975 | Wilkes et al. | 241/101 A X |
| 4,194,269 | 3/1980 | Reiche et al. | 241/101 A X |
| 4,479,285 | 10/1984 | Ragan | 19/80 R X |
| 4,483,225 | 11/1984 | Dankworth | 241/101 A X |
| 4,497,085 | 2/1985 | Van Doorn et al. | 241/101 A X |
| 4,766,648 | 8/1988 | Kerley | 19/80 R |
| 4,999,882 | 3/1991 | Hanselmann et al. | 19/80 R |

*Primary Examiner*—Donald T. Hajec
*Assistant Examiner*—Joseph A. Kaufman
*Attorney, Agent, or Firm*—Pearne, Gordon, McCoy & Granger

[57] ABSTRACT

A method and apparatus for separating an uncontaminated portion of a seed cotton module from a water-contaminated face stratum are disclosed. The technique includes conveying a contaminated cotton module toward a housing having a plurality of rotating fiber release bodies mounted therein. The housing and the conveyor are arranged for relative movement so that only the uncontaminated portion of the module is fed into the fiber release bodies while the contaminated face stratum passes beneath the bodies. The uncontaminated cotton is collected and conveyed to a cotton gin and the contaminated cotton is conveyed to a disposal location.

4 Claims, 6 Drawing Sheets

METHOD AND APPARATUS FOR SEPARATING AND FEEDING SEED COTTON MODULES

BACKGROUND OF THE INVENTION

This invention relates to techniques for feeding seed cotton bales or modules to cotton ginning apparatus. More particularly, this invention relates to techniques for feeding modules which have become contaminated with water prior to processing.

Cotton harvesting and processing have progressed from labor-intensive operations to highly mechanized operations which generally include the steps of harvesting, compressing the harvested bolls into bales or modules, and feeding the modules through pronged feed rollers so that the fibers are dislodged from the module and may be conveyed by a conveyor belt to the gin equipment.

It is not uncommon for the modules to be stored outdoors on slabs or on the ground in the fields prior to transportation to the feeders. As a result of such storage, it is also not uncommon for modules to be contaminated with water along a bottom layer or stratum and that layer may extend into the module for up to about 12 inches.

Modules being fed into feeders must be closely inspected to determine whether or not the module is contaminated. If modules are seriously contaminated, those modules would be diverted to an area adjacent the cotton gin, where workmen using pitchforks will break away the contaminated cotton from the module to leave the contaminated cotton in its compressed condition. The seed cotton thus removed from the module is picked up by a telescoping vacuum tube and is fed to the cotton gin. The contaminated remnants of each module must then be removed by front end loaders or the like. If contaminated modules are accidentally or deliberately delivered to the feeder, the ginned cotton will be of inferior quality.

SUMMARY OF THE INVENTION

This invention provides a technique for feeding only the uncontaminated portion of a module to a cotton gin while conveying a contaminated face stratum to a disposal area where the contaminated cotton may be dried or used as livestock feed. According to this invention, a seed cotton module having a water-contaminated face stratum is conveyed toward a plurality of powered rotary fiber release rolls which are mounted at one end of a tunnel-like frame. The position of the group of feed rolls is adjusted with respect to the contaminated module so that only that portion of the module which is uncontaminated is contacted by the rotary fiber release rolls. The contaminated stratum of the module is conveyed under the lowermost rotary fiber release roll and further conveyed to a disposal station. The released uncontaminated seed cotton is conveyed to the cotton gin.

According to one aspect of this invention, the apparatus comprises a tunnel-like frame having a plurality of powered, rotary, fiber release bodies fixed to one end of the frame and defining a fiber release zone. A conveyor having a conveyor surface for transporting a water-contaminated seed cotton module toward the zone generally defines the bottom of the tunnel-like frame. The frame is pivotally mounted with respect to the conveyor at a location spaced from the fiber release bodies and the end of the frame which mounts the fiber release bodies is connected to powered rams so that the fiber release bodies may be raised to a predetermined level above the conveyor to establish a space which generally corresponds to the vertical extent of the contaminated face stratum of the module.

According to another aspect of the present invention, the elevation of the conveyor may be lowered relative to the release bodies to establish the spacing so that the contaminated face stratum is free to pass beneath the release bodies.

According to a further aspect of the present invention, the conveyor may be hinged so that the end adjacent the fiber release bodies may be adjustably fixed in a position which establishes the predetermined vertical spacing beneath the lower one of the fiber release bodies. In this instance, feed to the release bodies is assisted by a gravitational component on the module.

According to a still further aspect of the present invention, the lowermost powered rotary fiber release body may be pivotally linked to the penultimate body so that the lowermost body may be moved in a clockwise or counterclockwise direction with respect to the penultimate body and then fixed in an adjusted position which will establish the required vertical spacing between the lowermost release body and the conveyor surface.

DETAILED DESCRIPTION OF THE INVENTION

Figure 1:
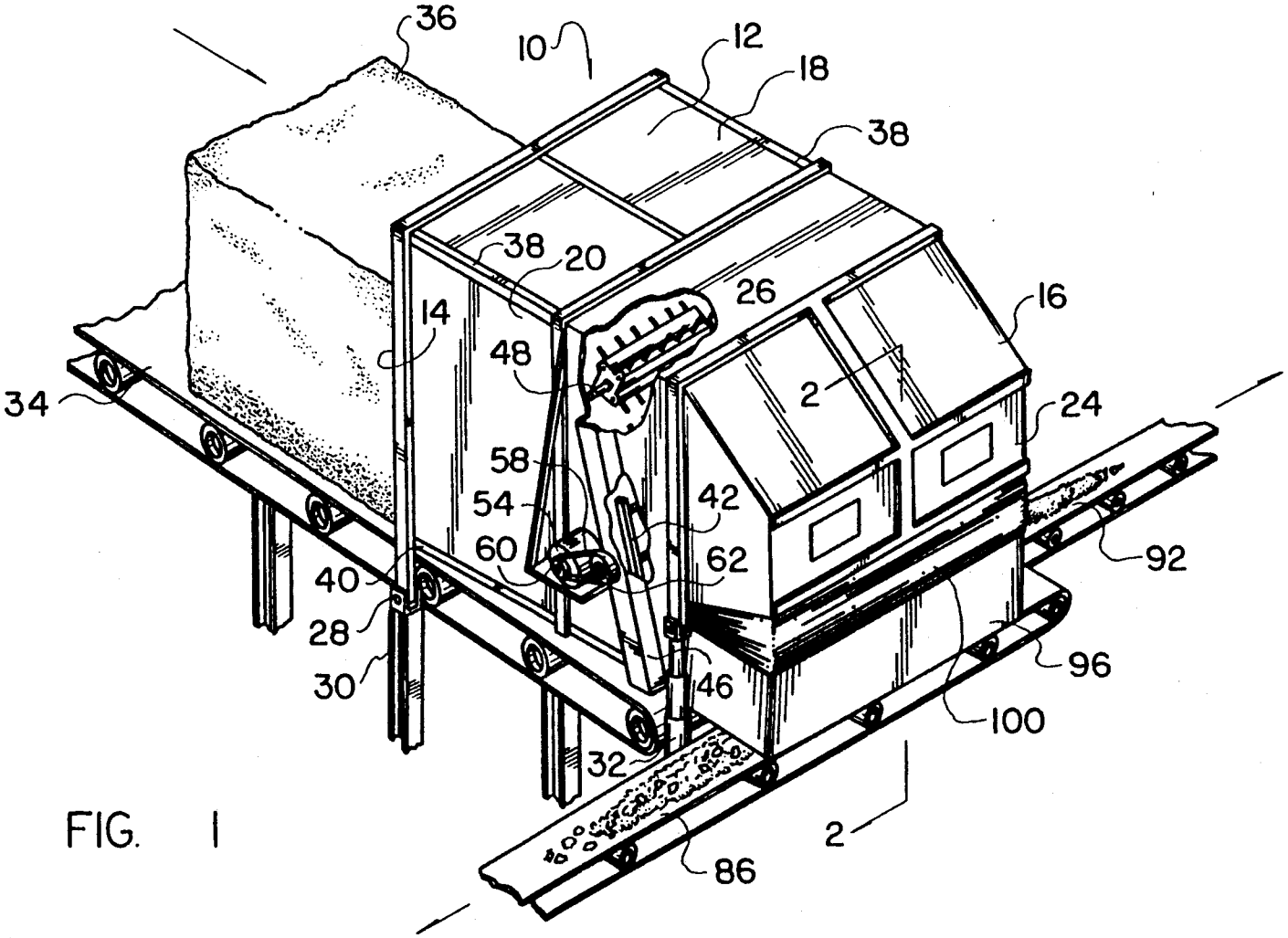
FIG. 1 is an isometric view of the module feeding apparatus according to this invention.
Figure 2:
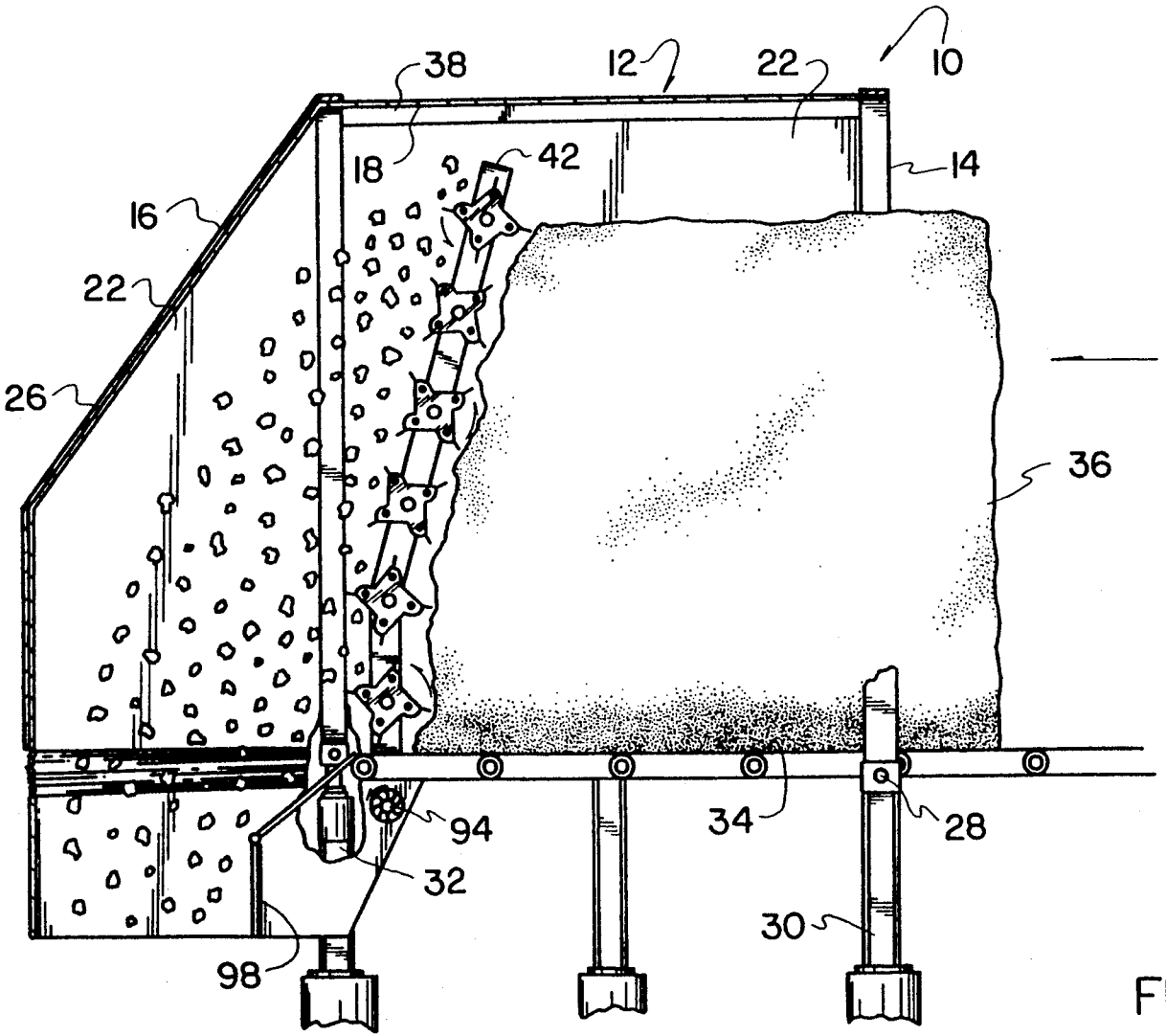
FIG. 2 is a vertical, longitudinal cross section through the apparatus, the plane of the section being indicated by the line 2—2 in FIG. 1.

Referring now to the drawings, and particularly to FIGS. 1 and 2, a module feeder 10 according to one aspect of this invention comprises a housing 12 having an open mouth 14 at one end and a closed shroud 16 at its other end. The housing 12 includes a top wall 18, side walls 20 and 22, and the shroud 16. The shroud 16 is defined by the side walls 20 and 22 and end wall 24 and a sloping top wall 26.

The end of the housing 12 having the open mouth 14 is pivotally mounted on a pair of oppositely disposed hinges 28 mounted on vertical supports 30.

The other end of the housing 12, i.e., the closed end, is mounted on a pair of hydraulically operated lifting jacks 32 so that the entire housing 12 may be pivotally raised or lowered about the hinge connections 28.

The bottom of the housing 12 is open and the housing 12 is positioned over a module conveyor 34, which is adapted to convey a module 36 of compressed seed cotton into the mouth 14 of the housing 12.

Fixed to upper and lower horizontal framing members 38 and 40 of the housing 12 are a pair of parallel inclined beams 42 which carry journal bearings 44 (FIG. 5) in a bearing housing portion 46 of each side wall 20 and 22.

Figure 4:
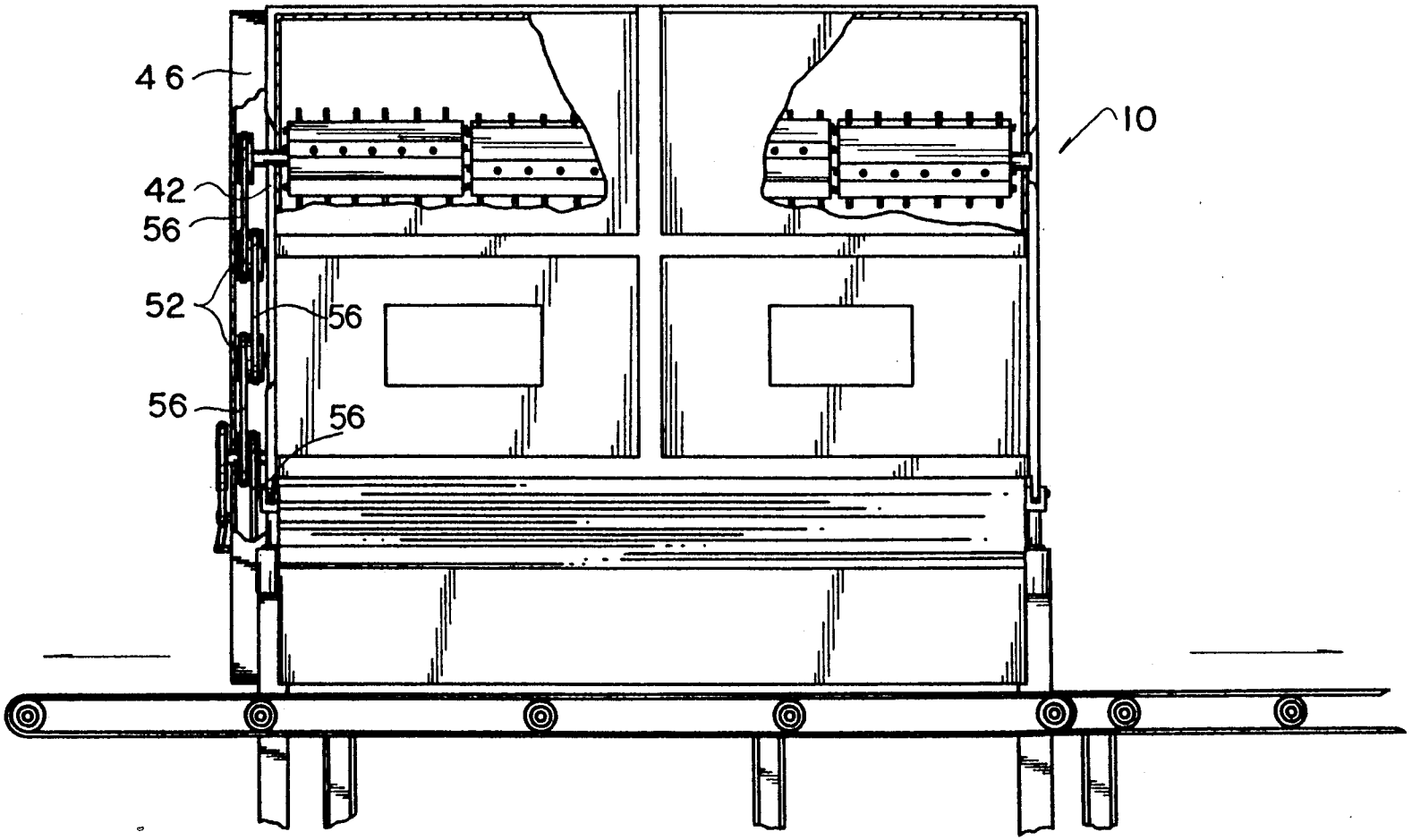
FIG. 4 is an end view of the apparatus, with portions being omitted for clarity.
Figure 5:
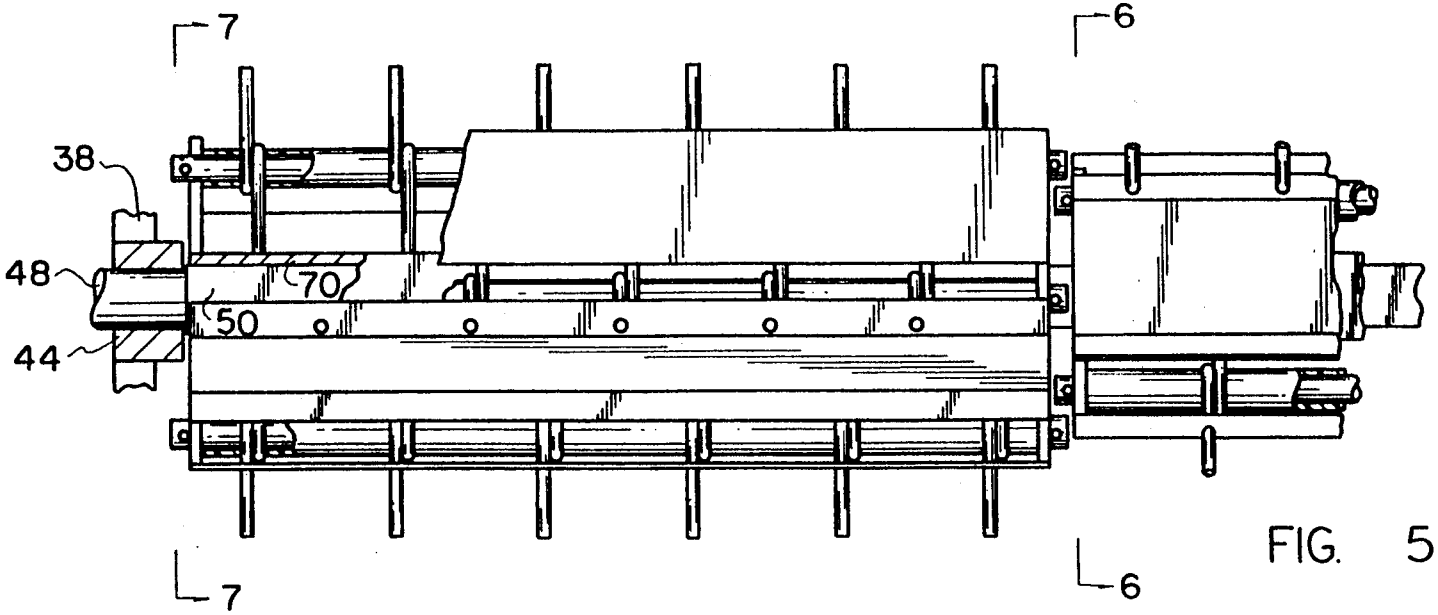
FIG. 5 is an enlarged, transverse section showing parts of the module feed rollers, portions being broken away for clarity.
Figure 7:
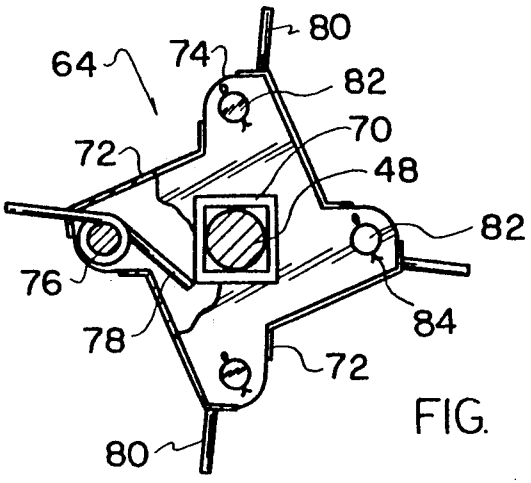
FIGS. 6 and 7 are detail sections, the plane of the sections being indicated by the lines 6—6 and 7—7 in FIG. 5.
Figure 6:
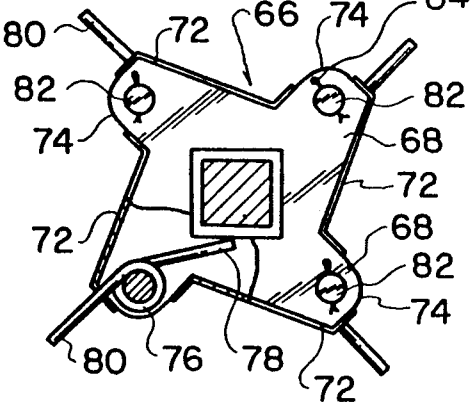

As may be seen in FIGS. 4 and 5, the bearings 44 carry journal portions 48 of six cross shafts 50, each having a sheave wheel 52 at one end thereof. All of the sheave wheels are driven by an electric motor 54 through belts 56 and 58 and additional sheave wheels 60 and 62.

Axially slidable but nonrotatable on the intermediate portion of each cross shaft 50 are a plurality of breaker/feeder bodies 64 and 66 each having four lobes 68. The bodies 64 and 66 are separated by rectangular spacers 70 loosely received on the shafts. The bodies are of hollow construction, with edge walls 72 forming openings 74 for admission into the interior of the body of coiled springs 56, each with end projections 78 and 80. Corresponding lobes 68 of each body 64 and 66 are aligned in the assembly and perforated to receive rods 82 which extend through and support the intermediate coils of the springs 76. As assembled, the inner ends 78 of the springs bear against the shaft spacers 70 and the outer ends 80 project approximately radially through the openings 74 for engaging the module 36 to remove material therefrom, as will be explained. The rods 82 are held in place by cotter pins 84 which are easily removable for withdrawal of the rods 82 and release of the breaker springs 76 for repair or replacement, without removal of the main shaft 50 or the spacers 70. In order to facilitate this replacement process, alternate ones of the breaker/feeder bodies are circumferentially staggered so that any of the rods 82 and their supported springs may be independently removed.

If an uncontaminated module 36 is conveyed into the open mouth 14 of the module feeder by the module conveyor 34, the rotating feeder bodies 64 and 66 engage the end of the module 36. When the rotating feeder bodies 64 and 66 engage the end of the module, material is released from the module, as is shown in FIG. 2, and propelled by the outer ends 80 of the coil springs 76 so that the material drops onto a transverse conveyor belt 86 to be conveyed to the cotton gin for further processing.

Figure 3:
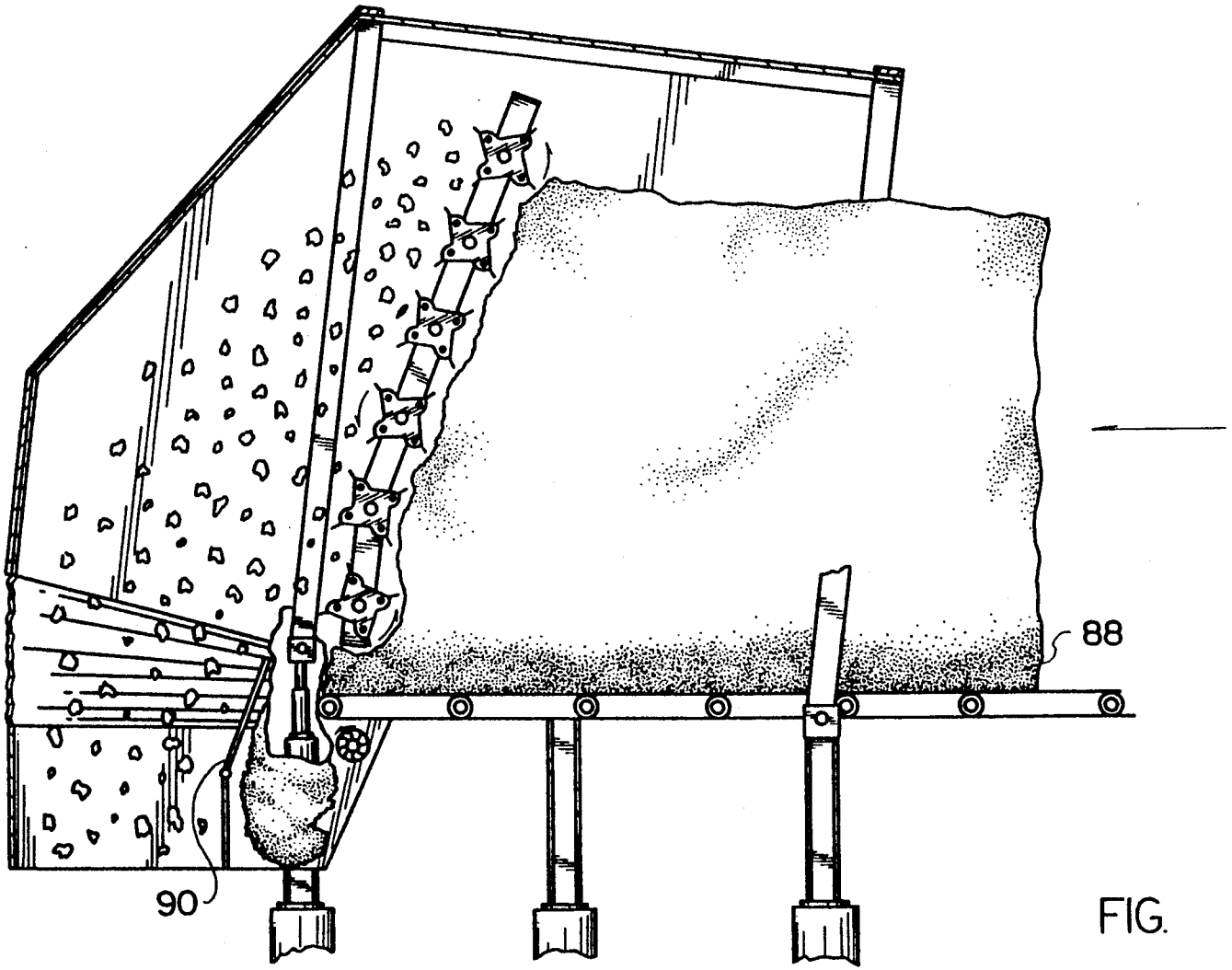
FIG. 3 is a cross-sectional view, similar to FIG. 2 but showing the forward end of the frame and the associated module feed rollers in an upwardly pivoted position.

If the module 36 is contaminated by moisture, thus providing a contaminated layer 88 as is shown in FIG. 3, the lifting jacks 32 are actuated to pivot the housing 12 about the hinges 28, to thereby raise the elevation of the breaker/feeder bodies 64 and 66. Thus, the lowermost breaker/feeder body is raised to a position where it will clear the contaminated layer 88 so that only uncontaminated material will be fed to the transverse conveyor 86. The contaminated layer is moved beneath the lowermost breaker/feeder body by the conveyor 34 and the contaminated layer 88 will be redirected by a deflector plate 90 to a transverse conveyor 92. The transverse conveyor 92 transports the contaminated cotton to a suitable disposal site for use as cattle feed and the like. To prevent any waste material from clinging to the return reach of the conveyor 34, a brush roll 94 is provided near the discharge end of the conveyor. It should be noted that a lower confining chamber 96 is stationary with respect to the housing 12 and includes a partition 98 which facilitates the separation of the layer 88 from the usable material. A flexible connection, such as a bellows 100, extends between the confining chamber 96 and the housing 12.

Figure 8:
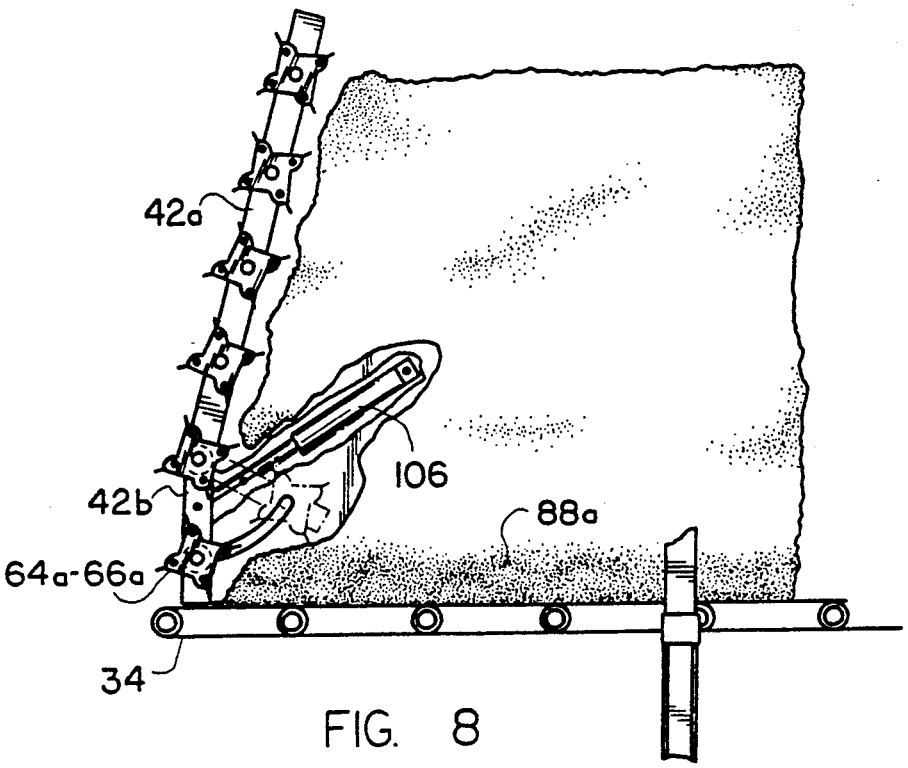
FIG. 8 is a view similar to FIG. 2 but showing a further aspect of the invention.

Referring now to FIG. 8, there is illustrated a breaker/feeder body arrangement which will permit the lowermost feeder body **64*a*–66*a* to clear the contaminated layer 88 by swinging the lowermost feeder body in a counterclockwise direction about an arc having a radius emanating from the axis of the penultimate feeder body. In this instance, the inclined beams 42*a* may be provided with a hinged connection 42*b* which will permit the lowermost breaker/feeder body 64–66*a* to be rotated to the position illustrated in phantom outline in FIG. 8 by a piston 106, which is pivoted to the housing 12. The feeder body may be locked in this position by the hydraulic cylinder 106** and/or a suitable mechanical lock (not shown).

Figure 9:
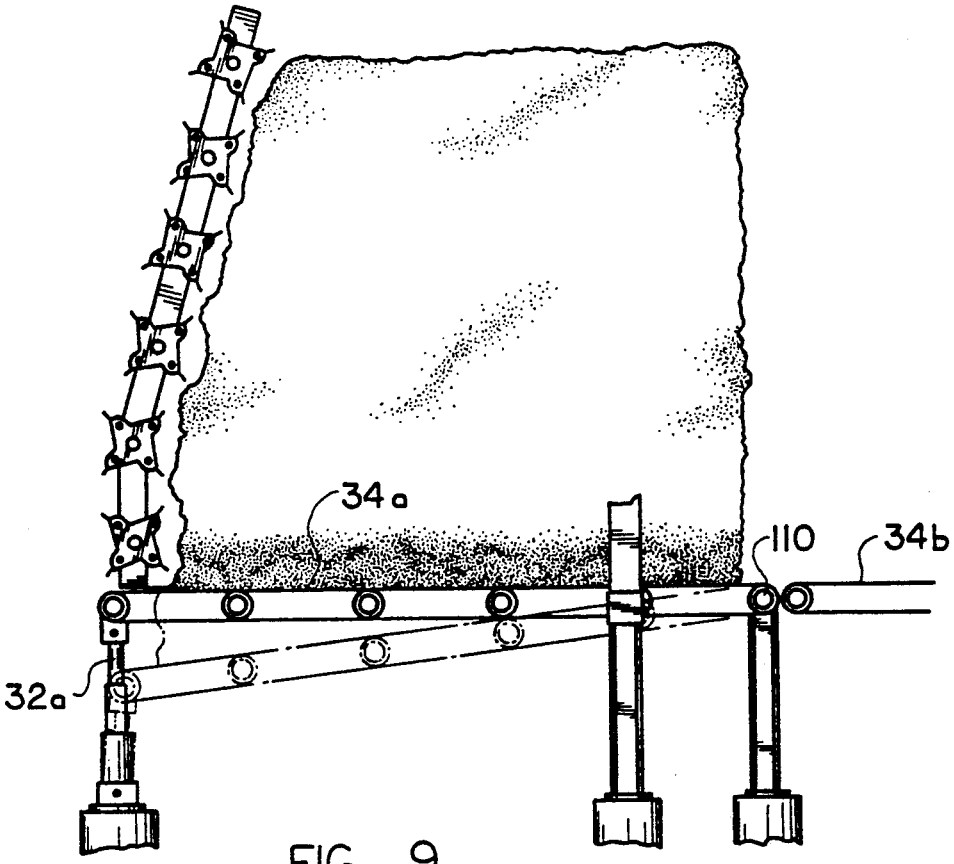
FIG. 9 is a view similar to FIG. 2, but showing a still further aspect of the invention.

According to a further aspect of this invention, the housing 14 may remain stationary while a forward end portion **34*a* of the module conveyor 34 is pivoted downwardly so the lowermost feeder body will clear the contaminated layer. Referring to FIG. 9, a forward section 34*a* of a module conveyor 34*b* is hinged at a pivot pin 110, while the other end of the section 34*a* is pivotally connected to a lifting jack 32*a*. Thus, the jack 32*a* may be lowered to slope the section 34*a* to its phantom outline position in FIG. 9 so that the contaminated layer 88 of the module 36 clears the lowermost breaker/feeder body. This arrangement is particularly advantageous in that a gravitational component aids in the feeding of the module 36** into the breaker/feeder bodies.

Although the preferred embodiments of this invention have been shown and described, it should be understood that various modifications and rearrangements of the parts may be resorted to without departing from the scope of the invention as disclosed and claimed herein.

What is claimed is:

1. Apparatus for separating an uncontaminated portion of a seed cotton module from a water-contaminated face stratum of the module, comprising a housing having an opening at one end thereof, a plurality of horizontally mounted, powered rotary fiber release bodies being arranged one above another to define a fiber release zone, conveyor means extending into said opening of the housing and having a conveying surface for transporting a water-contaminated seed cotton module toward said zone, and jacking means for adjusting the position of at least the lowermost one of said plurality of powered rotary fiber release bodies relative to the position of said conveying surface so that the spacing between the lowermost release body and the conveying surface corresponds to the vertical extent of a contaminated face stratum of said module.

2. Apparatus according to claim 1, wherein said means for adjusting includes pivot means for pivotally mounting said housing at a location spaced from said fiber release bodies and means to raise and lower said housing to an adjusted position establishing said vertical spacing.

3. Apparatus according to claim 1, including first conveyor means to convey released seed cotton from the fiber release bodies and second conveyor means to convey said contaminated face stratum from said release bodies.

4. Apparatus for separating and releasing an uncontaminated portion of a seed cotton module from a water-contaminated face stratum of the module, comprising a housing having an opening at one end thereof, a plurality of powered rotary fiber release bodies defining a fiber release zone, conveyor means extending into said opening of the housing and having a conveying surface for transporting a water-contaminated seed cotton module toward said zone, at least a lowermost one of said release bodies having jacking means for adjusting the position of said lowermost release body relative to the position of said conveying surface, means for collecting released uncontaminated cotton at a first location, means for preventing contaminated cotton from entering said zones, and means for collecting contaminated cotton at a second location.

* * * * *